US005231714A

United States Patent [19]

Mossbeck

[11] Patent Number: 5,231,714

[45] Date of Patent: Aug. 3, 1993

[54] MATTRESS FOUNDATION AND SUPPORT

[75] Inventor: Niels Mossbeck, Spring City, Tenn.

[73] Assignee: International Bedding Corporation, Fort Lauderdale, Fla.

[21] Appl. No.: 796,688

[22] Filed: Nov. 25, 1991

[51] Int. Cl.[5] ..... A47C 23/00

[52] U.S. Cl. ..... 5/400; 5/131; 5/186.1; 5/924

[58] Field of Search ..... 5/131, 186.1, 400, 401

[56] References Cited

U.S. PATENT DOCUMENTS

| | | | |
|---|---|---|---|
| 3,513,490 | 5/1970 | Wagner | 5/131 |
| 3,913,154 | 10/1975 | Sweeney | 5/186.1 |
| 3,967,331 | 7/1976 | Glassman | 5/236.1 |
| 3,973,281 | 8/1976 | Davis et al. | 5/131 |
| 4,181,991 | 1/1980 | Morgan et al. | 5/400 |

*Primary Examiner*—Michael F. Trettel

*Attorney, Agent, or Firm*—Arthur F. Zobal

[57] ABSTRACT

A support member has an enlarged rectangular shaped wall with an inner side and an outer side and four side walls extending from the inner side with free edges spaced from the enlarged rectangular shaped wall forming a rectangular shaped opening large enough to receive and support a mattress on the inner side of the enlarged rectangular shaped wall between the side walls. The enlarged rectangular shaped wall and the four side walls of the support member are formed of layers of fibrous material such as paper or fiberboard glued together. The enlarged rectangular shaped wall and the side walls of the support member are strong enough to allow the support member to be supported by the edges of the side walls on a surface and to support a mattress on the outer side of the enlarged rectangular shaped wall for sleeping purposes thereby forming a foundation for the mattress.

13 Claims, 7 Drawing Sheets

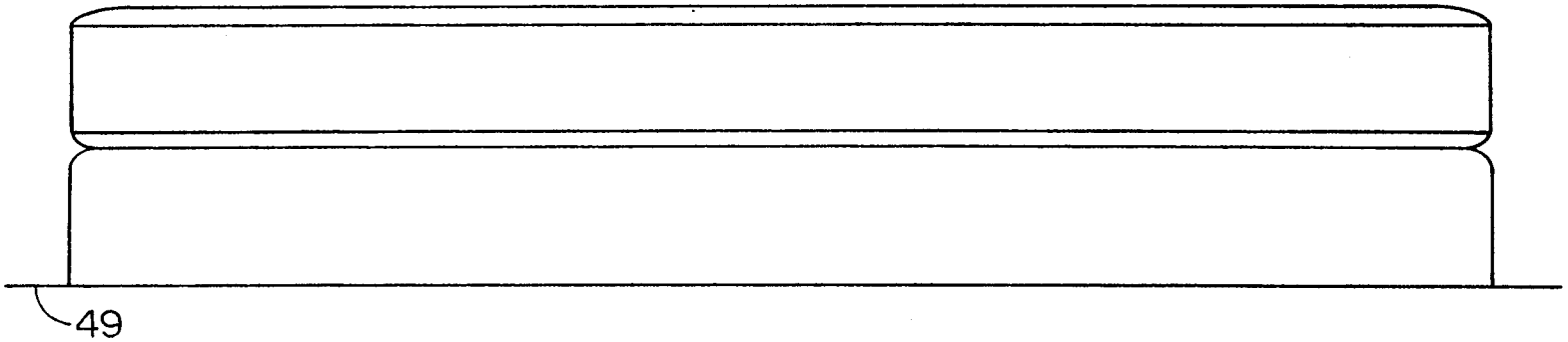
FIG. 7
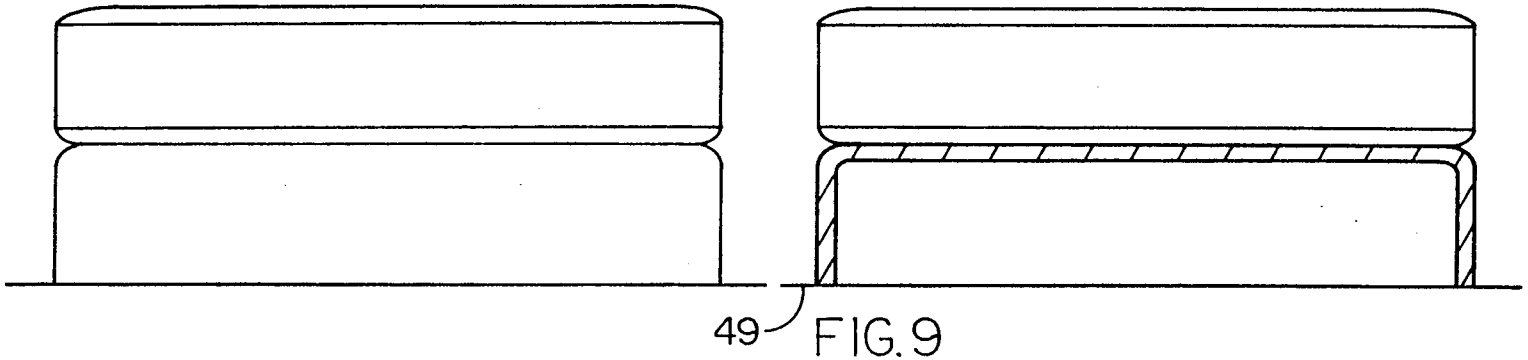
FIG. 8
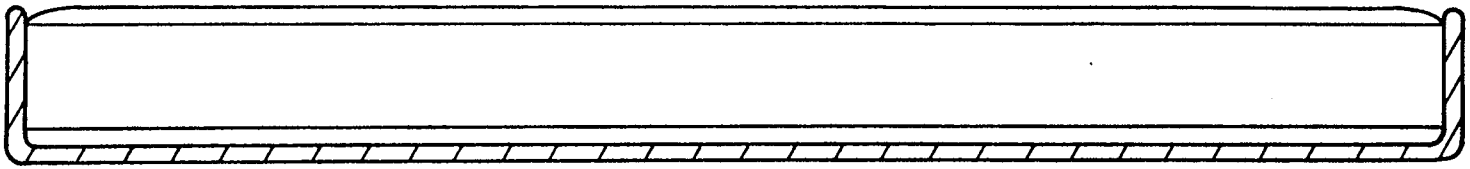
FIG. 9
FIG. 10

95
31
95
31

97

97
99

93

104
101
103

103
103

MATTRESS FOUNDATION AND SUPPORT

BACKGROUND OF THE INVENTION

1. Field of the Invention

The invention relates to a foundation for supporting a mattress for sleeping purposes.

b 2. Description of the Prior Art

Box springs and other types of supports have been used for many years as a foundation for a mattress. During shipping, however, the manufacturer has to ship two units, the conventional box springs and the mattress. The two units also must be handled and stored along the route between manufacture and sale by a retailer. Thus the two units of the conventional box springs and mattress increase the shipping, labor, and storage cost.

SUMMARY OF THE INVENTION

It is an object of the invention to provide a foundation for a mattress and which can also be used to transport and store the mattress thereby decreasing shipping, labor, and storage cost.

The foundation comprises a support member which has an enlarged rectangular shaped wall with an inner side and an outer side and four side walls extending from the inner side with free edges spaced from the enlarged rectangular shaped wall forming a rectangular shaped opening large enough to receive and support a mattress on the inner side of the enlarged rectangular shaped wall between the side walls. The enlarged rectangular shaped wall and the four side walls of the support member are formed of layers of fibrous material such as paper or fiberboard glued together. The enlarged rectangular shaped wall and side walls of the support member are strong enough to allow the support member to be supported by the edges of the side walls on a surface and to support a mattress on the outer side of the enlarged rectangular shaped wall for sleeping purposes thereby forming a foundation for the mattress.

BRIEF DESCRIPTION OF THE DRAWINGS

FIG. 7 is a side view of the foundation of the invention supporting a mattress on its top side for sleeping purposes.

FIG. 8 is an end view of the foundation of the invention supporting a mattress on its top side for sleeping purposes.

FIG. 9 is partial cross-sectional view of the foundation taken through its width with a mattress supported on its top side.

FIG. 10 is a cross-sectional view of the foundation taken through its length showing a mattress in its opening.

DESCRIPTION OF THE PREFERRED EMBODIMENTS

Figure 1:
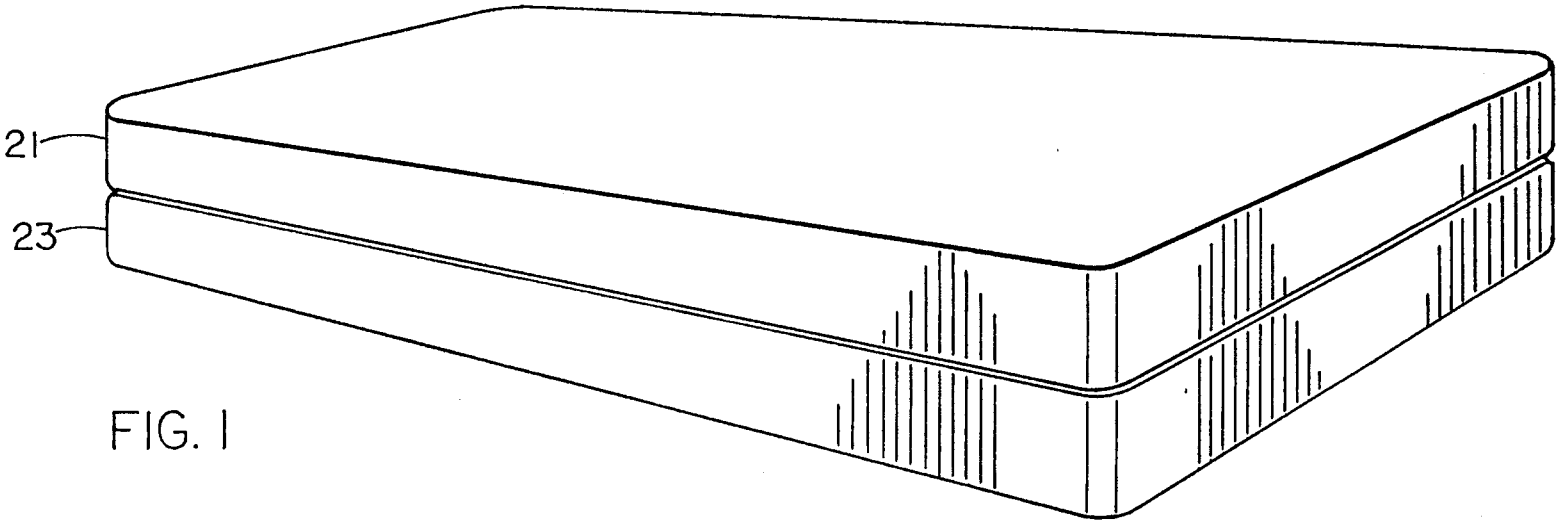
FIG. 1 is a perspective view of the foundation of the invention supporting a mattress on its top side for sleeping purposes.
Figure 2:
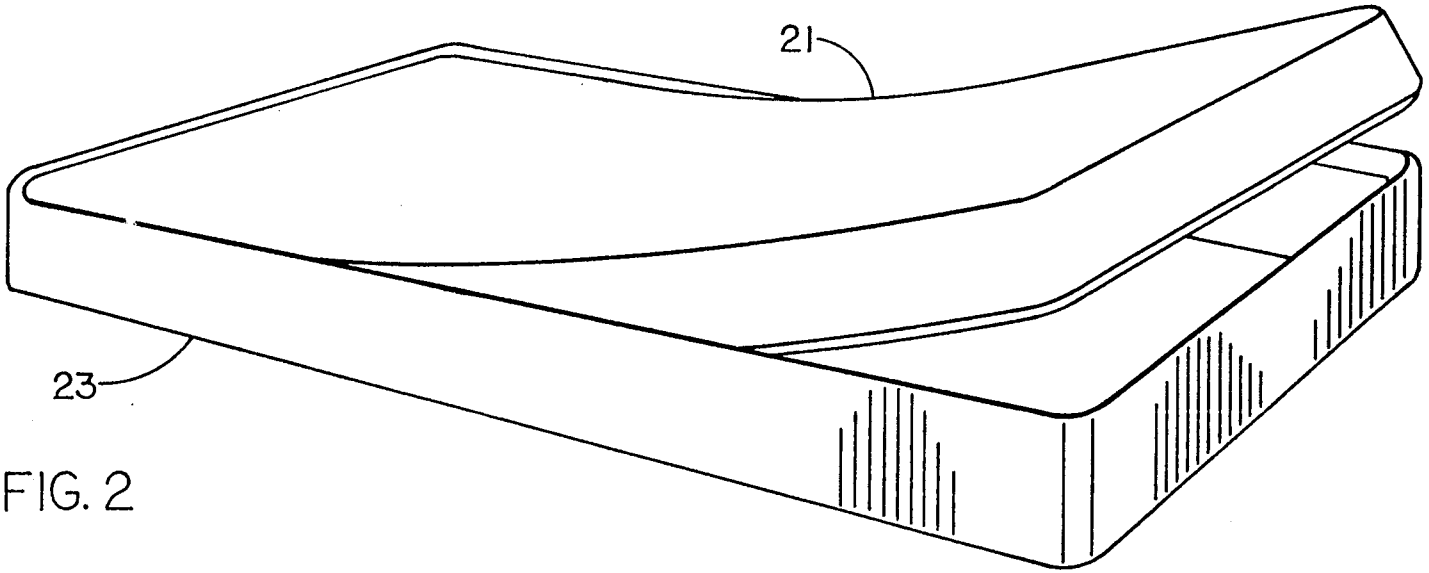
FIG. 2 is a perspective view of the foundation of the invention supporting a mattress inside the foundation for transportation or storage purposes.
Figure 3:
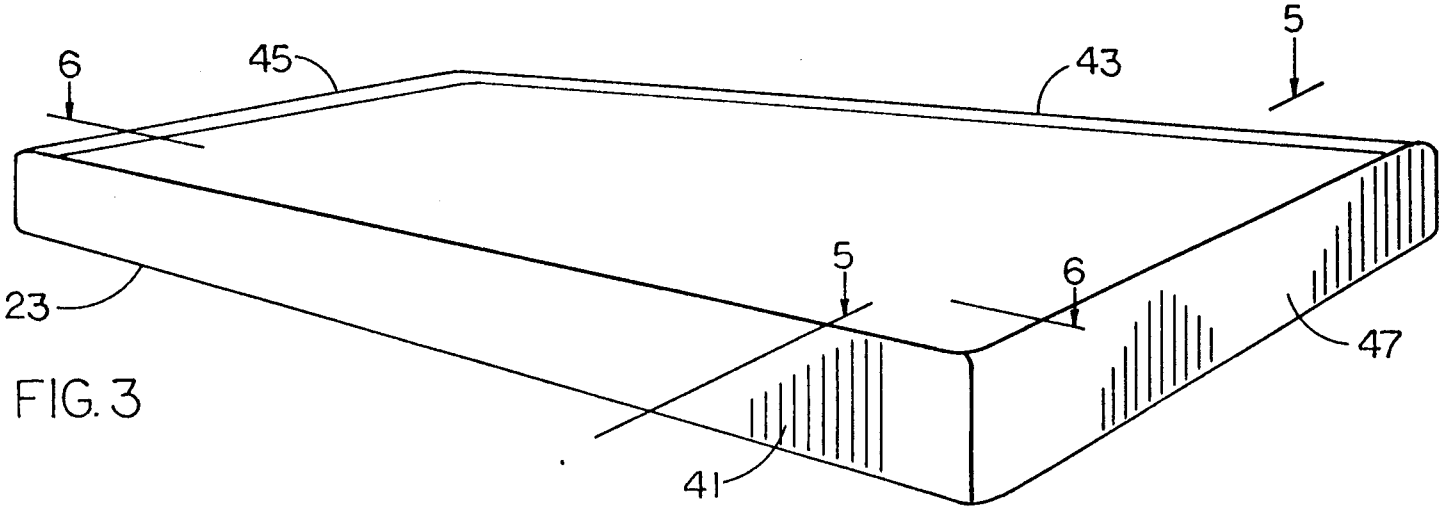
FIG. 3 is a perspective view of the foundation of the invention with non-skid material on its top side.
Figure 4:
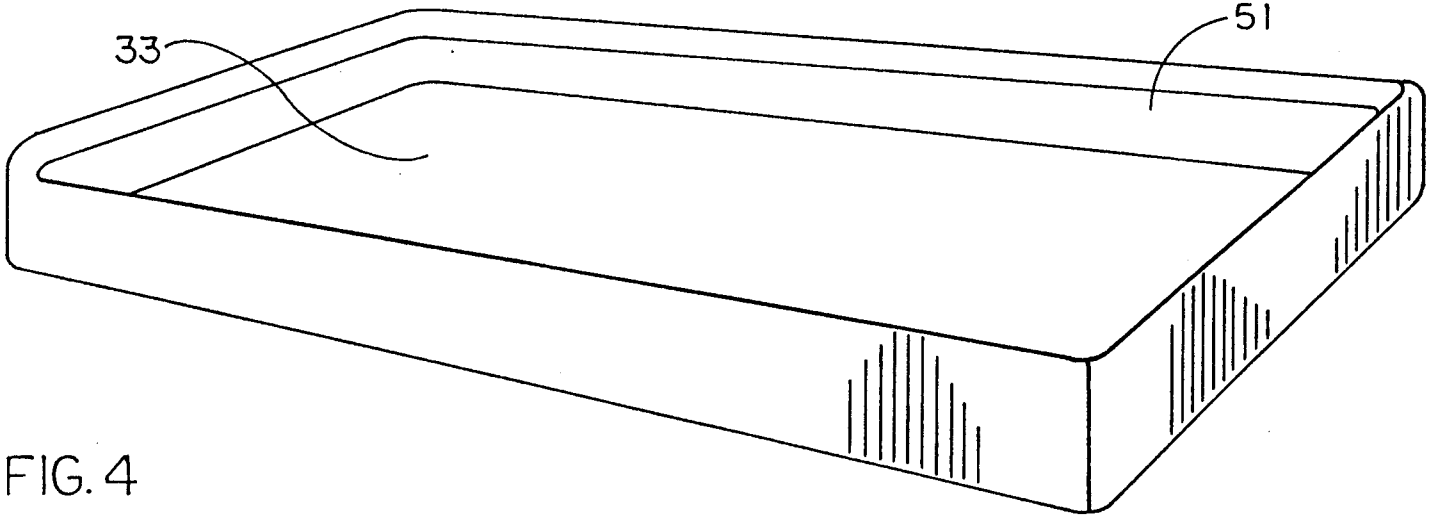
FIG. 4 is a perspective view of the foundation of the invention in an upside down position showing the mattress receiving opening.

Referring now to FIGS. 1–10 of the drawings reference numeral 21 identifies a conventional mattress and reference numeral 23 identifies the foundation of the invention. The mattress may be for example a twin size inner spring mattress having dimensions of 38½ inches ×74 inches×7 inches or a full size mattress having dimensions of 54 inches×74 inches×7 inches.

Figure 5:
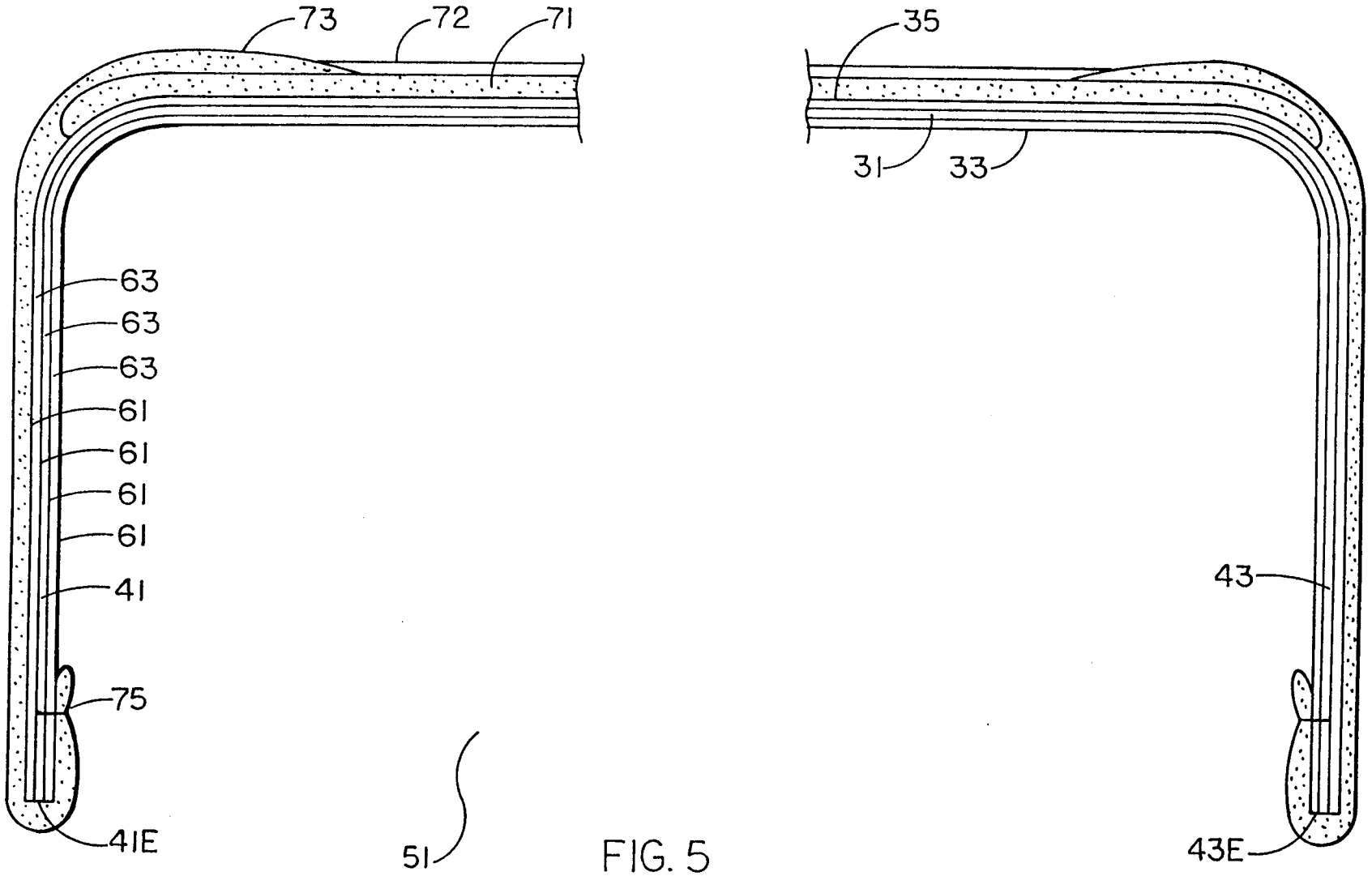
FIG. 5 is an enlarged partial cross-sectional view of FIG. 3, taken along the lines 5—5 thereof.
Figure 6:
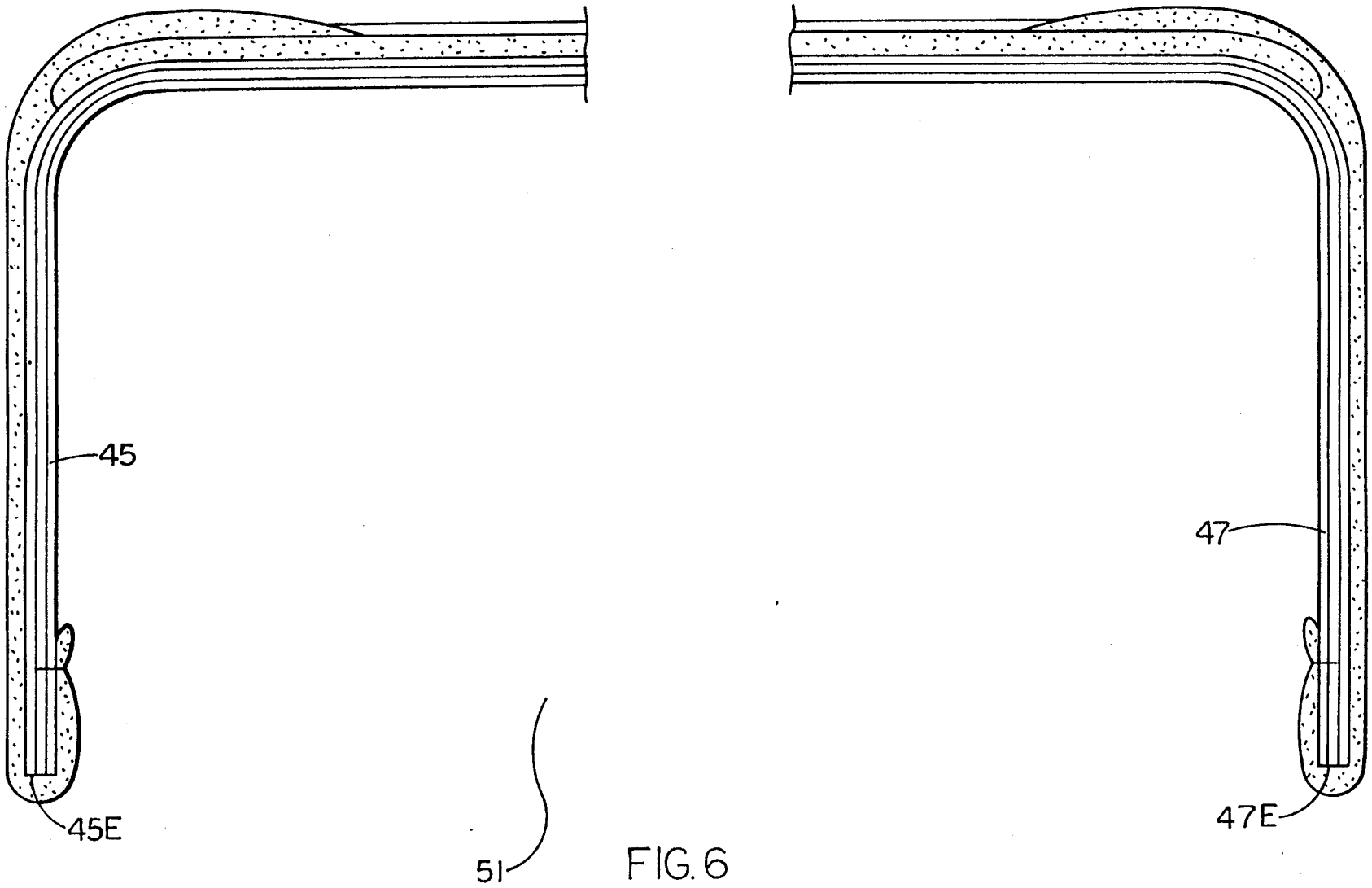
FIG. 6 is an enlarged partial cross-sectional view of FIG. 3 taken along the line 6—6 thereof.
Figure 19:
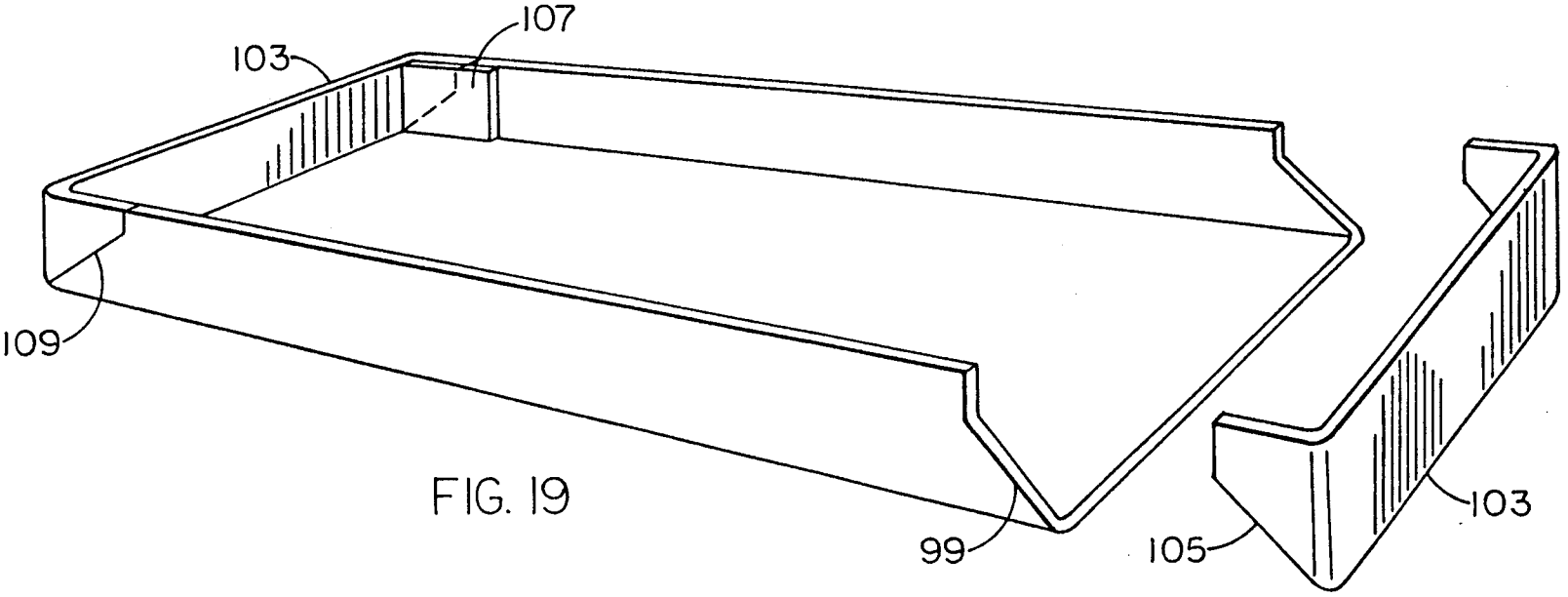
FIGS. 11–19 illustrates the process in which the foundation of the invention is produced.
Figure 12:
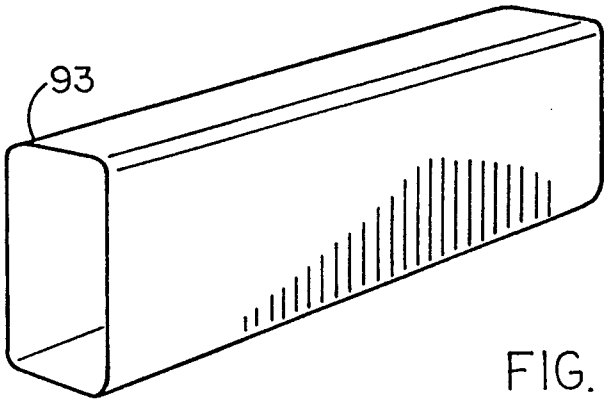
Figure 11:
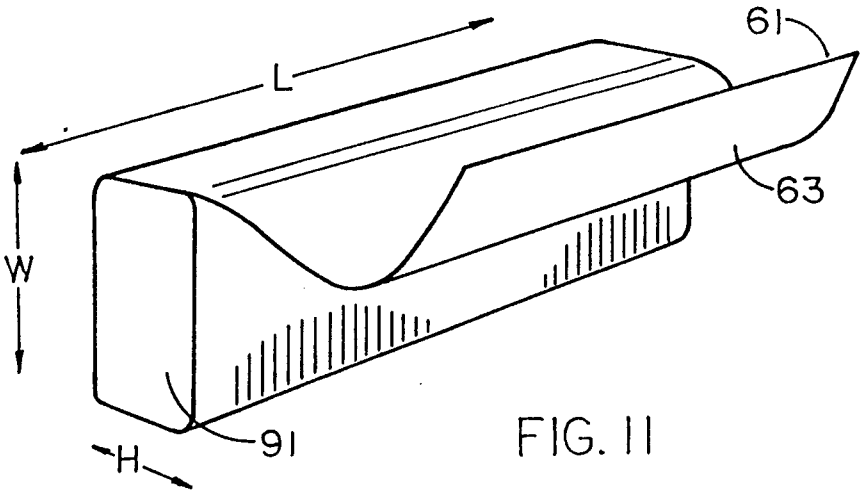

The foundation comprises a rectangular shaped wall 31 having an inside surface 33 and an outside surface 35 and four sides 41, 43, 45, and 47 extending from the edges of the inside surface. The sides 41, 43, 45, and 47 have edges 41E, 43E, 45E, and 47E spaced from the wall 31 in a plane forming a rectangular shaped opening 51 large enough to receive and support a mattress on the inside surface 33 of the wall 31 between the sides 41, 43, 45, and 47. For a twin size mattress the inside dimensions of the wall 31 may be 38½ inches×74 inches and the inside heights of the walls 41, 43, 45, and 47 may be 7 inches. Referring to FIGS. 5 and 6 the wall 31 and the four sides 41, 43, 45, and 47 are formed of layers 61 of paper or fiberboard or other fiber material glued and pressed together with glue 63. The paper layers may have a weight of 1½ onces per square foot and the glue may be polyvinyl alcohol glue. The thickness of the wall 31 and sides 41, 43, 45, and 47 may be about ¼ of an inch. This forms a strong and springy foundation structure which when supported by the side edges 41E, 43E, 45E, and 47E on a surface 49 will allow the mattress 21 to be supported on the outer surface 35 with a person or persons on the mattress for sleeping purposes. The thickness of the walls 31 and of the sides 41, 43, 45, and 47 can be greater than ¼ of an inch if desired.

For foundation purposes, preferably a rectangular shaped polyurethane foam layer 71 is located on the outside surface 35; a rectangular shaped non-skid layer of polyester 72 is located over the layer 71 and quilted tacking material 73 sewed to the edges of the layer 72 and extended around the outside walls of the sides 41, 43, 45, and 47, over the edges 41E, 43E, 45E, and 47E and attached to the inside of the walls 41, 43, 45, and 47 with glue or with staples 75.

After manufacture of the mattress 21 and foundation 23, the foundation may be turned upside down and the mattress squeezed and placed in the opening 51 and supported on the inside surface 33 for storage at the manufacturing facility or warehouse, for transportation to a retail establishment and for storage at the retail establishment until sold. Thus during storage and transportation, effectively only one unit is stored, handled, and transported thereby decreasing shipping, labor, and storage costs.

Figures 13, 14, 15, 16, 17, 18:
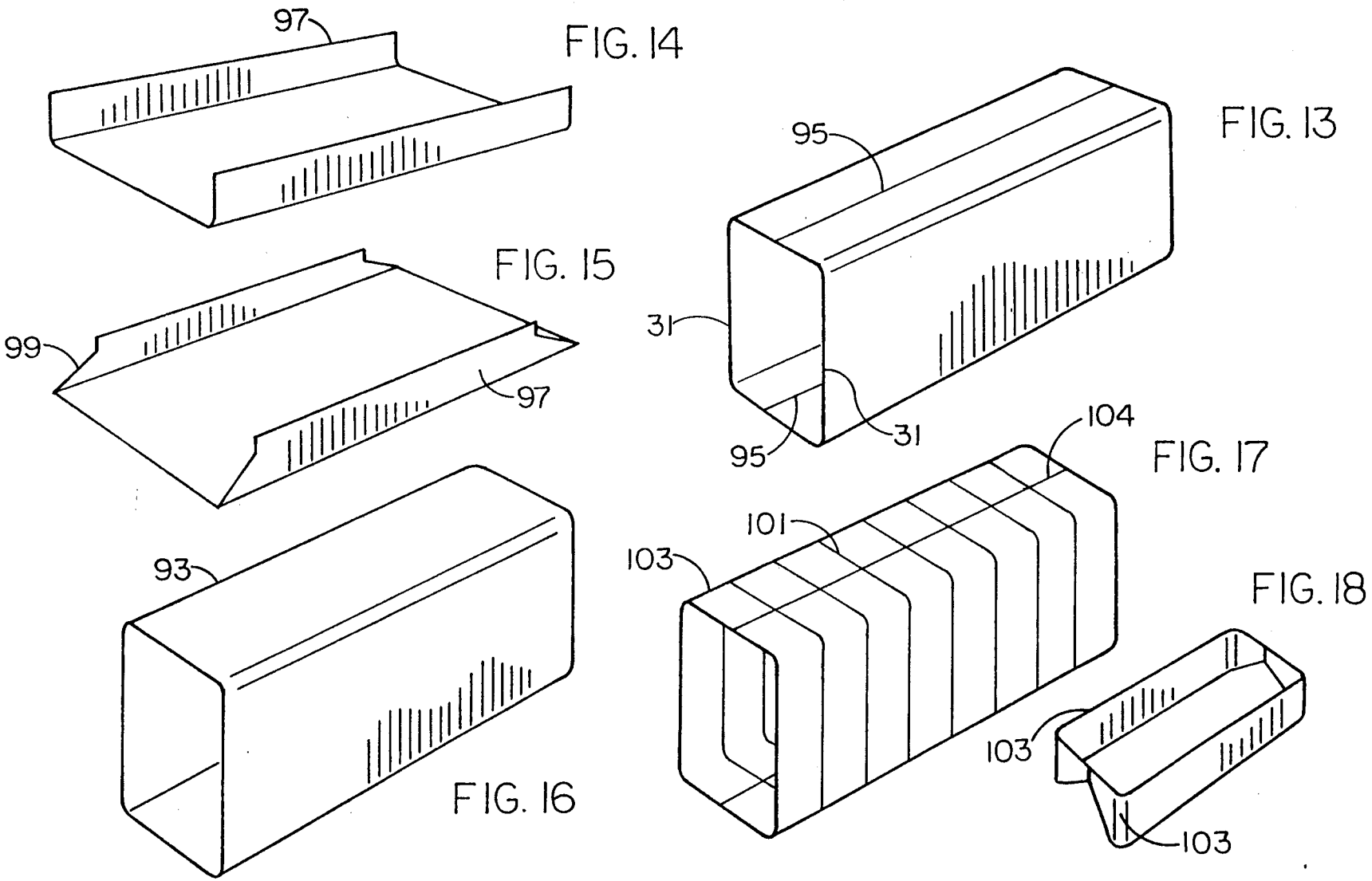

Referring now to FIGS. 11–19 there will be described the process of producing the foundation. A mold 91 is provided having a length L and a width W equal to the inside length and width of the wall 31. The height H of the mold is twice the height of the inside walls 41, 43, 45, and 47. Paper 61 with glue 63 on the underside is tightly wrapped around the mold 91 until the desired wall thickness is achieved. The wrapped member 93 then is removed from the mold 91 and sliced in half between the walls 31 as shown at 95 to form two half members one of which is shown at 97 in FIG. 14. The ends of members 97 are then cut in the configuration shown at 99 in FIG. 15. Another member 93 is formed as shown in FIG. 16 and sliced along its length as shown at 101 in FIG. 17 to form members 103. These members then are sliced in half along lines 104 and their ends cut in the configuration shown at 105 in FIGS. 18 and 19 which will fit the configuration 99. The end members 103 then are glued to the ends of member 97 to form the foundation 23. Small sheets of fiber board 107 are glued to the inside walls of sides 41 and 43 at each corner to cover and bond the joints 109 to provide strength. The board members 107 may be of the order of ¼ of an inch thick.

The foundation 23 may be formed of sheets of paper or thin sheets of fiberboard such as MASONITE stacked, and pressed around the mold 91 and glued so that the resulting member 93 will be formed of layers of paper or layers of fiberboard glued together The process of FIGS. 13-18 will be carried out as described above to form the foundation. The fiberboard sheets may be 1/16 of an inch thick and steamed to conform to the rounded edges of the mold. The foundation may be made of four layers of 1/16 inch thick fiberboard sheets such that its walls will have a total thickness of about ¼ of an inch or greater.

The foundation 23 can be made in different dimensions for use with different size mattresses.

I claim:

1. A foundation and support apparatus for a mattress of the type having a rectangular top and bottom and four sides, comprising:

a support member having an enlarged rectangular shaped wall with an inner side and an outer side and four side walls extending from said inner side with free edges spaced from said enlarged rectangular shaped wall forming a rectangular shaped opening large enough to receive and support a mattress on said inner side between the side walls, said enlarged rectangular shaped wall and at least two of said four side walls of said support member being formed of layers of plural fibrous material glued together continuously to form a single, solid unit, said enlarged rectangular shaped wall and said side walls of said support member being strong enough to allow said support member to be supported by said edges on a surface and to support a mattress on said outer side with a person on the mattress for sleeping purposes thereby forming a foundation for the mattress.

2. The foundation and support apparatus of claim 1 wherein, said layers of fibrous material comprise layers of paper.

3. The foundation and support apparatus of claim 1 wherein, said layers of fibrous material comprise layers of fiberboard.

4. A foundation and support apparatus for a mattress of the type having a rectangular top and bottom and four sides, comprising:

a support member having a enlarged rectangular shaped wall having a length and a width and an inner side and an outer side; two elongated side walls which extend from said inner side along said length of said enlarged wall; and two short side walls which extend from said inner side along said width of said enlarged wall;

each of said elongated side walls and each of said short walls extends from said inner side of said enlarged wall to a free edge, said enlarged wall and said two elongated side walls, along a substantial portion of said length, comprising a plurality of separate layers of fibrous material extending continuously from the free edge of one of said elongated side walls to the free edge of the other of said elongated side walls, with adjacent layers of said separate layers of fibrous material being glued together, said free edges of said short side walls and said free edges of said elongated side walls being spaced from said enlarged wall forming a rectangular shaped opening large enough to receive and support a mattress on said inner side between said short and elongated side walls, each of said short side walls comprises a plurality of separate layers of fibrous material with adjacent layers of said separate layers of fibrous material being glued together, said enlarged rectangular shaped wall and said short and elongated side walls of said mattress foundation being a single solid unit strong enough to allow said mattress foundation to be supported by said free edges on a surface and to support a mattress with a person on the mattress on said outer side for sleeping purposes, thereby forming a foundation for the mattress.

5. The foundation and support apparatus of claim 4 wherein, said layers of fibrous material comprise layers of paper.

6. The foundation and support apparatus of claim 4 wherein, said layers of fibrous material comprise layers of fiberboard.

7. The foundation and support apparatus of claim 4, wherein:

each of said elongated side walls has two opposite ends, said enlarged rectangular shaped wall having two opposite edges extending along the width thereof, each of said two short side walls comprising a separate member glued to one of said edges of said enlarged rectangular shaped wall and to two of said ends of said elongated side walls.

8. The foundation and support apparatus of claim 7, wherein:

each of said short side walls has a connected edge which is generally parallel to its said free edge, each of said short side walls has two opposite ends, each of said short side walls has two side wall connecting portions at its two ends respectively which extend transversely to said short side wall on the same side thereof and which has a free edge in the same plane as said free edge of said short side wall, said short side walls having their connected edges coupled to said opposite edges of said enlarged rectangular shaped wall and their two connecting portion coupled to two of said ends of said elongated side walls.

9. The foundation and support apparatus of claim 8, wherein:

each of said elongated side walls has a joined edge which joins said enlarged rectangular shaped wall along the length thereof, the free edge of each of said elongated side walls being generally parallel with its said joined edge, each of said ends of said elongated side walls comprises a transverse portion extending transversely from said free edge toward said joined edge to an angled portion which extends outward at an obtuse angle relative to said transverse portion, with said angled portion forming an acute angle relative to said joined edge, each of said connecting portions of said short side walls comprising a transverse portion which extends transversely from its free edge and about parallel to its said short side wall to an angled portion which extends to said connected edge and forms an obtuse angle relative to its said transverse portion and an acute angle relative to said short side wall, said short side walls having said transverse and angled portions of their two connecting portions coupled to said transverse and angled portions at opposite ends of said two elongated side walls, respectively.

10. A foundation and support apparatus for a mattress of the type having a rectangular top and bottom and four sides, comprising:

a support member having an enlarged rectangular shaped wall having a length and a width and an inner side and an outer side; two elongated side walls which extend from said inner side along said length of said enlarged wall; and two short side walls which extend from said inner side along said width of said elongated wall, each of said elongated side walls and each of said short walls extends from said inner side of said enlarged wall to a free edge, said enlarged wall and said two elongated side walls, along a substantial portion of said length comprising a plurality of separate layers of fibrous material extending continuously from the free edge of one of said elongated side walls to the free edge of the other of said elongated side walls, with adjacent layers of said separate layers of fibrous material being glued together, each of said short side walls comprises a plurality of separate layers of fibrous material with adjacent layers of said separate layers of fibrous material being glued together, said enlarged rectangular shaped wall and said short and elongated side walls of said mattress foundation being a single solid unit strong enough to allow said mattress foundation to be supported by said free edges on a surface and to support a mattress with a person on the mattress on said outer side for sleeping purposes, thereby forming a foundation for the mattress.

11. The foundation and support apparatus of claim 10, wherein:

each of said elongated side walls has two opposite ends, said enlarged rectangular shaped wall having two opposite edges extending along the width thereof, each of said two short side walls comprising a separate member glued to one of said edges of said enlarged rectangular shaped wall and to two of said ends of said elongated side walls.

12. The foundation and support apparatus of claim 11, wherein:

each of said short side walls has a connected edge which is generally parallel to its said free edge, each of said short side walls has two opposite ends, each of said short side walls has two side wall connecting portions at its two ends respectively which extend transversely to said short side wall on the same side thereof and which has a free edge in the same plane as said free edge of said short side wall, said short side walls having their connected edges coupled to said opposite edges of said enlarged rectangular shaped wall and their two connecting portion coupled to two of said ends of said elongated side walls.

13. The foundation and support apparatus of claim 12, wherein:

each of said elongated side walls has a joined edge which joins said enlarged rectangular shaped wall along the length thereof, the free edge of each of said elongated side walls being generally parallel with its said joined edge, each of said ends of said elongated side walls comprises a transverse portion extending transversely from said free edge toward said joined edge to an angled portion which extends outward at an obtuse angle relative to said transverse portion, with said angled portion forming an acute angle relative to said joined edge, each of said connecting portions of said short side walls comprising a transverse portion which extends transversely from its free edge and about parallel to its said short side wall to an angled portion which extends to said connected edge and forms an obtuse angle relative to its said transverse portion and an acute angle relative to said short side wall, said short side walls having said transverse and angled portions of their two connecting portions coupled to said transverse and angled portions at opposite ends of said two elongated side walls, respectively.

* * * * *